United States Patent [19]

Sheetz

[11] 4,125,986

[45] Nov. 21, 1978

[54] BAGGING APPARATUS

[75] Inventor: Charles E. Sheetz, Woodstock, Va.

[73] Assignee: FMC Corporation, San Jose, Calif.

[21] Appl. No.: 845,997

[22] Filed: Oct. 27, 1977

[51] Int. Cl.[2] ..... B65B 57/02; B65B 61/00

[52] U.S. Cl. ..... 53/75; 53/135; 53/138 A; 53/583

[58] Field of Search ..... 53/75, 134, 135, 138 A, 53/198 A

[56] References Cited

U.S. PATENT DOCUMENTS

| | | | |
|---|---|---|---|
| 3,283,474 | 11/1966 | Bower | 53/135 |
| 3,731,454 | 5/1973 | Crabb | 53/198 A X |

*Primary Examiner*—Travis S. McGehee
*Attorney, Agent, or Firm*—R. S. Kelly

[57] ABSTRACT

A bag at a filling station is automatically filled with loose fruit, such as apples, while the mouth of the bag is held open by a pair of finger gripping assemblies. Upon the conclusion of the filling operation the finger gripping assemblies, which are mounted upon a pivotable transfer arm, are swung away from the filling station to carry the filled bag into the throat of an automatic bag tying machine with the upper end of the bag being bunched together into a neck within the throat of the machine. When the bag is fully received in the throat of the machine, the machine is pivoted downwardly to bring the lower face thereof into engagement with the fruit in the bag. Thus, when the tie is thereafter applied about the neck of the bag within the throat of the machine a tight package is formed which will facilitate the later handling thereof and which will be more attractive to the ultimate consumer.

5 Claims, 5 Drawing Figures

FIG_4
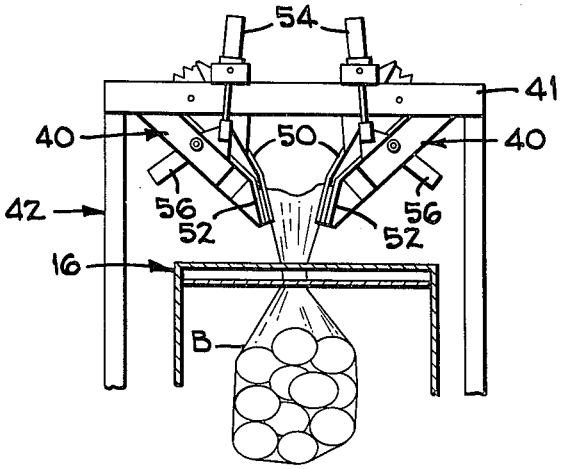
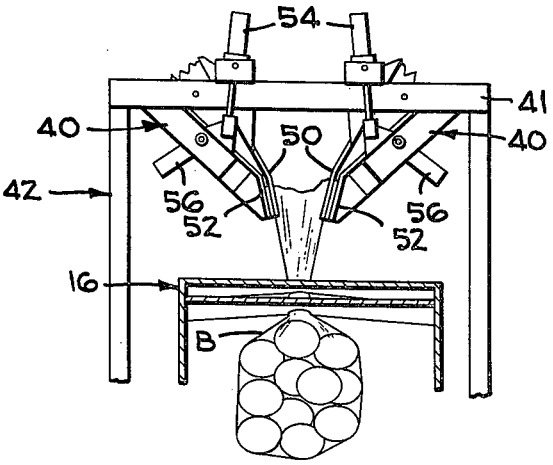
FIG_5

BAGGING APPARATUS

BACKGROUND OF THE INVENTION

1. Field of the Invention

The present invention pertains to apparatus for bagging loose articles, and more particularly, it pertains to apparatus for filling loose articles, such as apples, into a deformable bag and thereafter gathering the open end of the bag into a small neck and applying a tie thereabout.

2. Description of the Prior Art

In the fresh fruit packing industry freshly picked fruit is typically subjected to sorting, grading and bagging operations along a processing line in a packing house. In recent years, more and more of these various fruit processing steps are being accomplished automatically with automatic machinery. Today, there are automatic fruit processing machines in use at nearly every separate fruit handling operation in a commercial fruit packing and processing line.

While automatically operated equipment for weighing or counting fruit into bags has long formed a part of a typical packing house processing line, it has only been relatively recently that automatic machinery has been provided for holding the individual bags open at the bag filling station and thereafter automatically delivering the filled bag to a bag tying machine wherein a wire tie or the like can be applied thereto—such operation being conventionally manually performed in the past. One machine for performing such a bag transferring operation, wherein a filled bag of fruit is moved from the filling station to a bag typing machine, is shown in U.S. Pat. No. 3,864,894, issued to Charles E. Sheetz et al on Feb. 11, 1975. In the apparatus shown in this patent, loose fruit is delivered into a bag which is being held open by a pair of finger gripping assemblies. The finger gripping assemblies are adjustably secured to a transfer arm which is mounted for swingable movement about a pivot axis located at the base of the apparatus. Upon the completion of the bag filling step, the transfer arm is swung so that the open bag is carried frm the filling station into the throat of the bag typing machine wherein said open end of the bag is gathered together into a constricted neck to which a wire tie is thereafter automatically applied.

One of the problems with the aforedescribed bagging apparatus is that the tie may be applied too high above the fruit in the bag since the tie is applied at the same elevation each time as determined by the expected maximum height which the fruit may take in their stacked arrangement within the bag just prior to the application of the tie. Thus, upon completion of the bagging operation, the fruit will be free to roll around in the bag which makes for poor bag handling conditions during subsequent processing. For example, it is particularly difficult to stack bags of fruit for transportation to the marketplace or for arrangement and display in the marketplace when the fruit is free to shift with relative ease within the loose confines of the bag. Also, loose fruit in the bag presents an unattractive package to the ultimate consumer, and the relatively unimpeded movement of the fruit within the bag may encourage bruising or other damage to the fruit.

SUMMARY OF THE INVENTION

The bagging apparatus of the present invention is basically similar to the apparatus shown in the aforementioned U.S. Pat. No. 3,864,894 and includes an automatic bag filler, an automatic bag tier, and a bag transferrer for sequentially moving each filled bag from the filler to the tier. The bag is gripped at its open upper end while it is being filled and is thereafter moved into the throat of the tying machine by the gripping means with such open end of the bag being gathered into a narrow neck portion about which the bag tie is subsequently applied. In accordance with the present invention, however, means are provided to automatically lower the bag tying machine relative to the filled bag once the bag is in the throat of the bag tying machine so as to bring the bag tying machine into engagement with the articles in the bag. Then, the tie will be applied to the constricted neck portion of the bag so as to result in a tightly packaged final product with the fruit being incapable of shifting about within the bag.

The foregoing result is accomplished by mounting the bag tying machine for vertical movement, by providing powered means to move the bag tying machine vertically, and by providing switch means to activate the bag tying machine mover to lower the machine with such switch means being activated when the bag transferring device moves the bag within the throat of the bag tying machine.

With the apparatus of the present invention a very attractive finished package of fruit is provided which will be pleasing to the ultimate consumer and which lessens the chances of bruising or other damage to the fruit. Also, the tightly packaged bag of fruit is more easily handled both manually and by conventional handling equipment and may be readily stacked for transportation to the marketplace.

BRIEF DESCRIPTION OF THE DRAWINGS

FIG. 4 is a section generally taken along line 4—4 of FIG. 1 and illustrating the initial position of the filled bag when it is brought into the throat of the bag tying machine.

FIG. 5 is a section similar to FIG. 4 but illustrating the final position of the filled bag within the bag tying machine when the tie is applied.

DESCRIPTION OF THE PREFERRED EMBODIMENT

Figure 1:
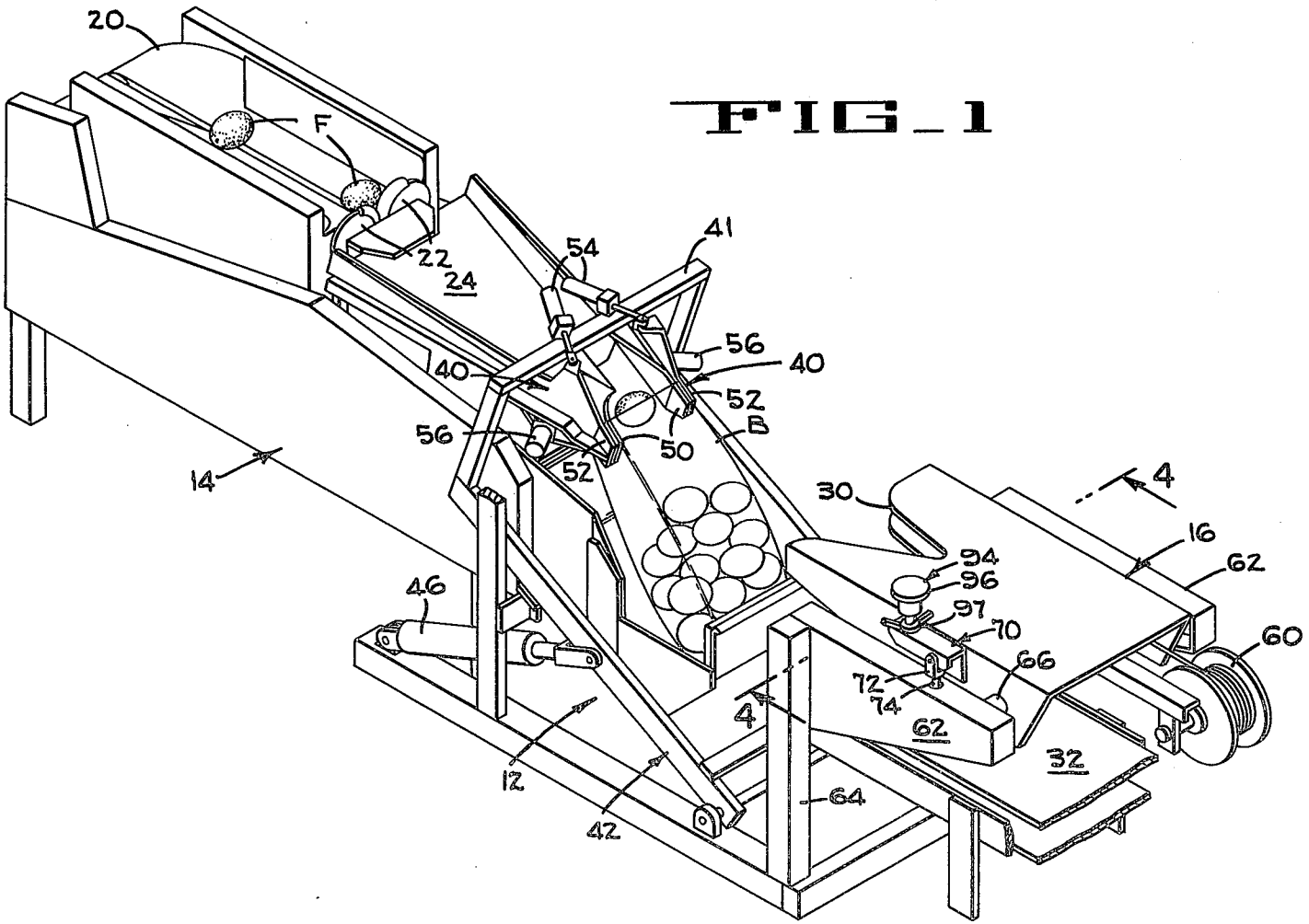
FIG. 1 is a perspective of the bagging apparatus of the present invention including an automatic bag filling machine, an automatic bag tying machine, and a bag transferrer for moving each filled bag between the filling and tying machines.

Referring now more particularly to the drawings, FIG. 1 illustrates the bagging apparatus of the present invention which will be seen to include a fruit weighing and bag filing machine 14, a bag tying machine 16, and a bag transferring device 12 which is operated to hold the open end of a bag open during the filling operation and, upon the conclusion of the filling operation, to transfer the bag into the generally V-shaped throat 30 of the bag tying machine. After a tie has been applied to the bag in the tying machine the transferring device releases the bag allowing it to fall onto an underlying take-away conveyor 32 which transports it to the next fruit processing station (not shown), e.g., boxing or stacking for transportation to the marketplace. After depositing the filed and tied bag upon the take-away conveyor the transferring device returns to the filling station to receive a new bag and repeat the cycle.

The fruit weighing and bag filling machine 14 is comprised of a conveyor 20 that receives fruit F from an upstream fruit processing line (not shown). The conveyor is a multi-belt conveyor that transfers the fruit in single file arrangement, as shown in FIG. 1, past a pair of gates 22 and into a hopper 24 which is pivotally mounted upon a scale beam mechanism. The gates 22 are operated to block the passage of fruit into the hopper when the weight of the fruit therein reaches a predetermined value as determined by the scale mechanism. The weighing and filling machine further includes a stacked supply of wicketed empty bags with the end bag B (FIG. 1) being blown open by an air blower (not shown) within the machine in preparation for filling. In operation, the bag B is opened while the conveyor 20 passes fruit individually into the hopper 24. When the predetermined quantity of fruit has been deposited in the hopper, the gates 22 are closed to cut off further fruit delivery and the hopper is pivoted about its downstream end to pour said predetermined quantity of fruit into the bag which is being held open by the transferring device 12. A fruit weighing and filling machine of the type described is shown in U.S. Pat. No. 3,695,371 which issued to Charles E. Sheetz on Oct. 3, 1972, and reference to such patent may be had for a further and more complete description of the apparatus and its mode of operation.

The bag transferring device 12 includes a pair of finger gripping assemblies 40 which grip the laterally opposed side edges of the bag to hold the bag open during the filling operation as shown in FIG. 1. The gripping assemblies 40 are mounted upon a crossbar 41 which is carried by a pivotable frame assembly 42. The frame assembly is mounted upon an axle 44 (FIG. 2) at the base of the apparatus and is arranged to be pivoted about the generally horizontal axis of the axle by means of a power cylinder and piston device 46 secured to one of the upright members of the frame assembly as shown. The pivoting movement of the frame assembly 42 upon the completion of the filling of the bag brings the filled bag of fruit from the filling station at the machine 14 into the throat 30 of the bag tying machine 16 as previously explained. During such transfer movement the gripping finger assemblies 40 are swung inwardly toward each other, as shown in FIG. 4, so as to constrict the open end of the bag and allow it to more easily enter the throat of the tying machine where it is gathered into a tightly constricted neck portion. Each of the finger gripping assemblies 40 will be seen to include an inner finger 50 and an outer finger 52 both of which are pivotally mounted upon the crossbar 41. A power cylinder and piston 54 is provided to pivot the outer finger 52 relative to the crossbar, and a power cylinder and piston 56 is mounted between the outer finger 52 and the inner finger 50 so as to pivot the inner finger relatively to the outer finger. By means of appropriate pneumatic and electrical circuitry the inner and outer fingers are moved relatively to each other and to the supporting crossbar to grip the side edges of the bag at the appropriate time, to release the bag after the tie has been applied, to move over the bag and into bag gripping position upon the return of the transferring device to the filling station, and to move together inwardly as the bag is moved into the throat of the bag tying machine (FIG. 4) to constrict the open end of the bag. A complete description of the bag transferring device 12, including the pneumatic and electrical control circuitry therefor, is disclosed in the aforementioned U.S. Pat. No. 3,864,894 issued to Charles E. Sheetz et al on Feb. 11, 1975, and this prior patent is specifically incorporated by reference herein for a more complete description of such apparatus and its mode of operation.

The bag tying machine 16 is an entirely conventional apparatus for applying wire ties or the like about the tightly gathered neck of a deformable bag. Such machine includes a supply wheel 60 upon which a supply of tying wire is stored in a coil. When the bag B is brought within the throat 30 of the tying machine and the side walls of the bag are gathered together into a tightly constricted neck, the operative components of the tying machine are energized by a cycling switch (not shown) to bring a strip of tying wire from the suply wheel 60 into a position encircling the gathered neck of the bag. Then, by appropriate means not shown, the tie is tightly wrapped about the neck of the bag and secured thereto. One commercially available bag tying machine which may be used in the apparatus of the present invention is the Super Mini-Tie, manufactured by Doboy Packaging Machinery, a division of Domain Industries, Inc., New Richmond, Wis.

Figure 2:
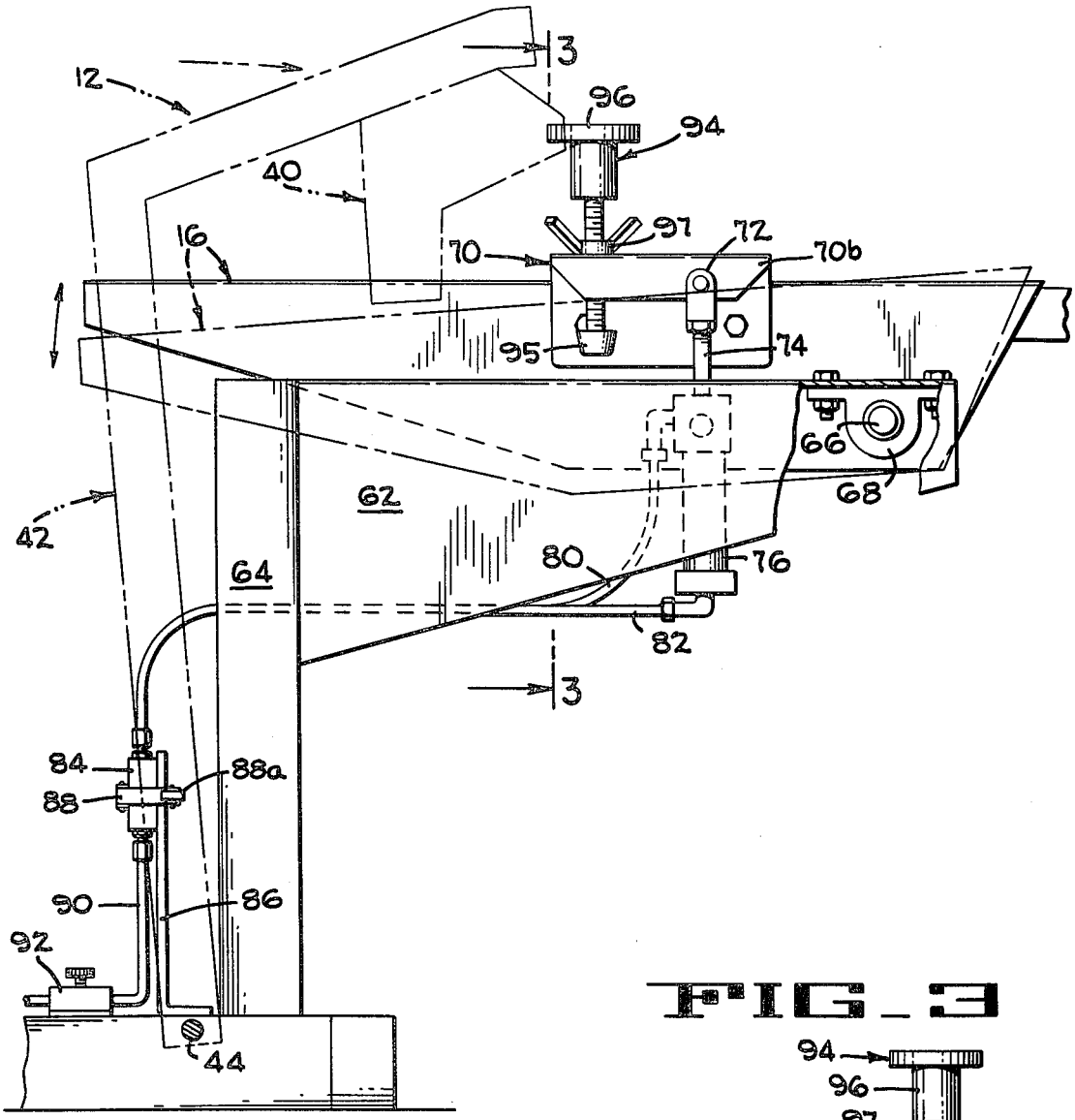
FIG. 2 is an enlarged side elevation of the bag tying machine particularly illustrating the means for vertically moving such bag tying machine and with the bag transferrer and the depressed position of the bag tying machine being indicated in phantom lines.

As can be seen from the drawings, the bag tying machine 16 is mounted upon an upright frame structure which includes a pair of horizontally arranged side plates 62 that are secured to upright posts 64 to maintain the tying machine at an elevation so as to apply the tie about the upper end of the bag when it is swung into position by the bag transferring device 14. The downstream end of the bag tying machine will be seen to be mounted upon a transversely extending axle member 66 which is secured at each end to a pillow block bearing structure 68 attached to the underside (FIG. 2) of the adjacent side plate 62. An inverted channel-shaped bracket 70 is bolted to one side of the bag tying machine and includes an outwardly projecting upper wall **70*a* with a downwardly projecting flange 70*b* at the outer end thereof. Pivotably attached to the downwardly projecting flange 70*b* by means of a clevis 72 is a piston rod 74 which is operatively moved in a vertical direction by means of an air cylinder 76 that is rotatably secured to depending brackets 78 (FIG. 3) within the adjacent fixed side plate 62. Air under pressure is directed into or exhausted from the cylinder 76 by means of air lines 80 and 82 which are attached to a conventional air valve 84. The air valve is mounted upon an upright mounting bracket 86 that is secured to the base frame structure of the apparatus as shown in FIG. 2. The air valve 84 is a conventional 3-way, two position air valve which alternatively directs air under pressure through one line 80, 82 while exhausting from the other. The valving action of the air valve is controlled by means of a pivotable switch arm 88 carrying a roller 88*a* at the distal end thereof which is adapted to be engaged by one of the upright members of the transfer frame assembly 42 when it moves into its downstream position delivering the deformable bag B into the throat 30 of the bag tying machine, as particularly shown in the phantom line illustration in FIG. 2. The air valve 84 is connected on its upstream side to a source of air under pressure (not shown) by means of a supply line 90**, said supply line further including an adjustable flow control valve 92 which may be manually adjusted to control the rate of flow of air to the valve and thereby control the speed of downward movement of the bag tying machine just prior to the application of the bag tie.

Referring now to FIGS. 4 and 5, it will be seen that as the bag B is brought into the bag tying machine 16, a neck will be formed near the upper end thereof so that regardless of the amount or shape of the articles within the bag, the bag will easily move into the bag tying machine without damaging any of the fruit. At the time when the bag is fully secured within the throat 30 of the bag tying machine, the frame assembly 42 will engage switch arm 88 to reverse the air within the cylinder 76 and cause the piston rod 74 to move donwardly bringing the tying machine from the full line to the phantom line position as shown in FIG. 2. This will lower the throat of the bag tying machine wherein the underside of the machine is in a position in engagement with the fruit within the bag, as shown in FIG. 5, so that when the tie is subsequently applied about the neck of the bag a tight fruit package will be provided.

Figure 3:
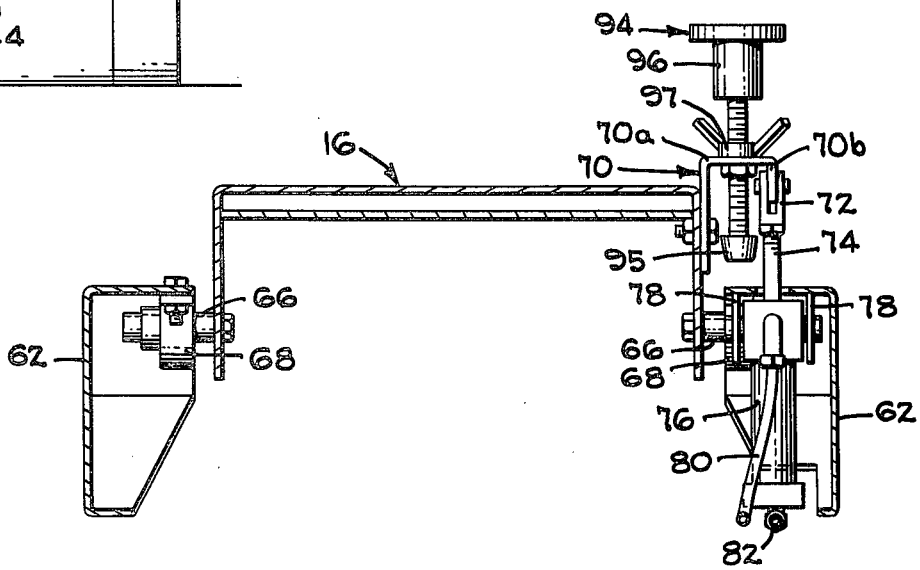
FIG. 3 is a transverse section taken on line 3—3 of FIG. 2.

The distance which the bag tying machine 16 is lowered is rendered adjustable by means of a rotatable adjustment member 94 which is threaded through the upper wall 70*a* of the mounting bracket 70 as shown in FIGS. 2 and 3. A resilient stop member 95 is secured to the bottom of the adjustment member and an enlarged handle 96 is attached to the upper portion thereof to allow for ready manual adjustment of the bag tying machine movement. An underlying nut (FIG. 3) and overlying wing nut 97 allow for tight securement of the adjustment member relative to the mounting bracket 70. Thus, it will be seen that the bag tying machine will be moved vertically upon actuation of air cylinder 76 until the stop member 95 strikes the upper horizontal wall of the adjacent side plate 62 to stop further downward movement of the machine, the elevation of such stop member being readily adjusted by the means aforedescribed.

From the foregoing description it can be seen that the vertically shiftable mounting of the bag tying machine in the bag filling, transferring and tying apparatus of the present invention allows for a tight securement to be made each time that a bag is brought to the tying machine with excess bag space being eliminated. The aforementioned prior art problems encountered with loosely bagged fruit are thus obviated with the structure of the present invention which will be seen to provide advantages both for the fruit packer and for the ultimate consumer.

Although the best mode contemplated for carrying out the present invention has been herein shown and described, it will be apparent that modification and variation may be made without departing from what is regarded to be the subject matter of the invention.

What is claimed is:

1. In a bagging apparatus comprising means for filling a predetermined quantity of loose fruit into a bag at a filling station, gripping means for holding the upper end of the bag in an open condition while the bag is filled, means for moving said grippng means and a filled bag carried thereby from said filling station to a bag tying station upon the conclusion of the filling operation, an automatic bag tying machine at said bag tying station, said bag tying machine having a throat for receiving the upper end of the bag and for bunching it into a neck, said bag tying machine further including means for securing a tie about said neck of the bag, and means for releasing said bag from the gripping means after said tie has been applied thereto, the improvement comprising means for mounting said bag tying machine for vertical movement, switch means activated by said means for moving said gripping means when said bag is received within said throat of the bag tying machine, and means activated by said switch means for moving said bag tying machine downwardly into contact with the fruit in the bag whereby a tight package is formed when said tie is subsequently applied about said neck of the bag.

2. In a bagging apparatus as set forth in claim 1 wherein said bag tying machine is pivotally mounted at one end thereof for movement about a generally horizontal axis, said throat being on the opposite end of the bag tying machine from said one end.

3. In a bagging apparatus as set forth in claim 2 wherein said switch means comprises a valve and wherein said means for movng said bag tying machine downwardly comprises a cylinder controlled by said valve and having a piston connected to said bag tying machine.

4. In a bagging apparatus as set forth in claim 3 including an adjustable stop means for limiting the maximum distance of travel of said piston within said cylinder to thereby limit the distance which said bag tying machine is lowered.

5. In a bagging apparatus as set forth in claim 2 wherein said means for moving the bag from the filling station to the tying station comprises an arm rotatable about a generally horizontal axis and mounting said gripping means at the distal end thereof whereby said bag moves in a generally arcuate path between said filling and tying stations.

* * * * *